US008718304B2

(12) United States Patent
Pedersen

(10) Patent No.: US 8,718,304 B2
(45) Date of Patent: May 6, 2014

(54) HEARING INSTRUMENT CONFIGURED FOR WIRELESS COMMUNICATION IN BURSTS AND A METHOD OF SUPPLYING POWER TO SUCH

(75) Inventor: Brian Dam Pedersen, Ringsted (DK)

(73) Assignee: GN Resound A/S, Ballerup (DK)

( * ) Notice: Subject to any disclaimer, the term of this patent is extended or adjusted under 35 U.S.C. 154(b) by 169 days.

(21) Appl. No.: 13/083,555

(22) Filed: Apr. 9, 2011

(65) Prior Publication Data

US 2011/0255722 A1 Oct. 20, 2011

(30) Foreign Application Priority Data

Apr. 14, 2010 (EP) ..... 10159930

(51) Int. Cl.
*H04R 25/00* (2006.01)

(52) U.S. Cl.
USPC ..... 381/315; 381/323

(58) Field of Classification Search
USPC ..... 381/312–331, 337–433; 330/251; 439/884
See application file for complete search history.

(56) References Cited

U.S. PATENT DOCUMENTS 4,689,819 A * 8/1987 Killion ..... 381/321
5,095,261 A * 3/1992 Schoofs ..... 323/222
5,131,046 A * 7/1992 Killion et al. ..... 381/321
5,247,704 A * 9/1993 Greenwood ..... 455/73
5,414,340 A * 5/1995 Gannon ..... 323/266
6,028,417 A * 2/2000 Ang et al. ..... 323/209
6,104,759 A 8/2000 Carkner et al.
6,173,063 B1 1/2001 Melanson
6,509,785 B2 * 1/2003 Ang et al. ..... 327/538
6,552,599 B1 4/2003 Xu
6,741,715 B2 * 5/2004 Andersen ..... 381/323
6,829,364 B2 * 12/2004 Andersen et al. ..... 381/323
8,126,175 B2 * 2/2012 Tateno et al. ..... 381/315
8,175,306 B2 * 5/2012 Meskens et al. ..... 381/315
2005/0013447 A1 1/2005 Crump et al.
2006/0233405 A1 10/2006 Brooks et al.
2009/0067653 A1 3/2009 Meskens et al.
2009/0236140 A1 * 9/2009 Randall ..... 174/268
2010/0158292 A1 6/2010 Pedersen

FOREIGN PATENT DOCUMENTS

CN 1262023 A 8/2000
DK PA 2008 01829 12/2008

(Continued)

OTHER PUBLICATIONS

Chinese Office Action and Search Report dated Jul. 30, 2013, for related CN Patent Application No. 2011-10094229.2, 21 pages.

*Primary Examiner* — Davetta W Goins
*Assistant Examiner* — Oyesola C Ojo
(74) *Attorney, Agent, or Firm* — Vista IP Law Group, LLP

(57) ABSTRACT

A hearing instrument configured to receive power from an energy source, the energy having an output voltage, the hearing instrument includes an analog-to-digital converter for conversion of an input audio signal to a digital input signal, a digital signal processor for processing the digital input signal into a processed signal, an audio amplifier for amplifying the processed signal, a communication unit for wireless data communication between the hearing instrument and another device, and a stabilizing circuit having an energy storing element and a rectifying element, wherein the energy storing element is configured to supply power to one or more of the analog-to-digital converter, the digital signal processor, and the audio amplifier, and the rectifying element is configured to prevent the energy storing element from supplying power to the communication unit.

26 Claims, 8 Drawing Sheets

(56) References Cited

FOREIGN PATENT DOCUMENTS

| | | |
|---|---|---|
| EP | 0 405 783 A2 | 1/1991 |
| EP | 0405783 | 1/1991 |
| EP | 1 247 426 | 9/2004 |
| EP | 1 247 426 B1 | 9/2004 |
| EP | 1 272 001 | 1/2005 |
| EP | 1 272 001 A1 | 1/2005 |

* cited by examiner

HEARING INSTRUMENT CONFIGURED FOR WIRELESS COMMUNICATION IN BURSTS AND A METHOD OF SUPPLYING POWER TO SUCH

RELATED APPLICATION DATA

This application claims priority to and the benefit of European patent application No. EP 10159930.6, filed on Apr. 14, 2010, the entire disclosure of which is expressly incorporated by reference herein.

FIELD

The present application relates to a hearing instrument having a communication unit for wireless data communication between the hearing instrument and another device. Furthermore, the present application relates to a method of supplying power to a hearing instrument configured for wireless data communication. The wireless data communication may be in bursts.

BACKGROUND AND SUMMARY

In U.S. Pat. No. 6,173,063, a hearing aid having a voltage regulator for regulating the voltage from a battery to a class D output is disclosed.

In US 2006/0233405, a hearing aid having a voltage controlled current limiter for limitation of the current supplied to an audio amplifier is disclosed.

The two above-mentioned disclosures describe hearing aids adapted to regulate and limit, respectively, the power supplied to an output amplifier of the hearing aid in response to power consumption by the output amplifier.

Typically, in a hearing instrument, such as a hearing aid, only a limited amount of power is available from the energy source (power supply). For example, in a hearing aid, power is typically supplied from a conventional $ZnO_2$ battery.

Typically, a wireless communication circuitry requires significant amounts of power, during both reception and transmission of data.

A communication unit in a hearing instrument, such as a communication unit for wireless communication in bursts, may, at least during the bursts, draw a significant current from the energy source. This drain of current may cause a significant transient voltage drop from the energy source due to an often relatively large internal resistance in the energy source. One or more units in the hearing instrument may be sensitive towards such a drop in supply voltage—which drop may result in reduced sound quality and/or in interrupted operation of the one or more units.

In EP 1 272 001, a hearing aid having a capacitor coupled in parallel with an energy source is disclosed. A capacitor coupled in parallel with an energy source in a hearing aid will during transient loads inherently supply current to the same parts of the hearing aid as the energy source otherwise would supply power to. Typically, in a hearing instrument, such as a hearing aid, only one energy source, such as a battery, is provided. All power consuming parts of such a hearing instrument are therefore typically provided with power from that one energy source, and accordingly the capacity of such a capacitor must correspond to the overall transients in power consumption, resulting in a capacity requirement of for instance 1-20 mF or higher.

Thus, there is a need for a new hearing instrument and method.

Interconnections between units of a hearing instrument will be referred to throughout the application. As some of the embodiments described herein relate to power supply for hearing instruments these mentioned interconnections are electrical power supply connections, unless specifically referred to as signal connections (typically implicitly electrical) or wireless signal connections (typically radio or inductive connections).

According to a first aspect, a hearing instrument comprising a communication unit (COM) is provided. The COM may be configured for data communication, e.g. wireless, between the hearing instrument and another device, e.g. in a wireless network. The data communication, or at least part of it, may be in bursts (communication bursts), also known as duty cycled communication.

The hearing instrument may have an analog-to-digital converter (ADC) for conversion of an input audio signal to a digital input signal. The hearing instrument may have a microphone (MIC) for conversion of sound into the input audio signal.

The hearing instrument may further have a signal processor (DSP), such as a digital signal processor, for processing the digital input signal into a processed signal.

The hearing instrument may further have an audio amplifier (AMP) for amplifying the processed signal. The hearing instrument may further have a receiver (REC) for conversion of the amplified processed signal into sound.

The hearing instrument may further have an energy source (BAT) for power supply to the hearing instrument. The energy source may comprise a battery. The energy source may be exchangeable. The energy source may have an output voltage.

In accordance with the first aspect, the hearing instrument may further have at least one stabilizing circuit including a first stabilizing circuit.

The first stabilizing circuit may, e.g. at least during a transient drop in the output voltage of the energy source, be configured to provide a stabilized supply voltage to a first sub-circuit of the hearing instrument. A transient drop in the output voltage of the energy source may be due to the communication unit. The first sub-circuit may comprise at least one of the following: the analog-to-digital converter, the digital signal processor, and the audio amplifier. The first stabilizing circuit may comprise a first energy storing element and a first rectifying element. The first energy storing element may be adapted to supply power, at least transitory, to the first sub-circuit. The first rectifying element may be adapted to prevent the first energy storing element from supplying power to the communication unit.

Thus, it is an advantage that for a hearing instrument, having a communication unit, and one, more or all the other energy consuming parts of the hearing instrument, which are supplied with power from the same energy source, at least one of the other energy consuming parts has the supply of power stabilized at least during a transient voltage drop. Such stabilization may prevent the relevant part(s) of the hearing instrument from malfunction and/or function in an undesired way when or if the energy source is influenced by the COM in such a way that the supply of power is changed, e.g. by a drop in voltage. Thus, such stabilization of the supply of power is in particular relevant for the part(s) of the hearing instrument being more sensitive to e.g. a drop in supplied voltage, due to instability and/or reduced sound quality. A similar transient voltage drop due to high load on the energy source may also occur in situations with transient sound peaks where the AMP draws a high current or where the DSP has an especially complex processing.

The at least one stabilizing circuit may comprise a single unit or may be divided into more units. The at least one stabilizing circuit may be adapted to stabilize, e.g. by adjusting, regulating, smoothing, limiting, etc., the power, i.e. the voltage and/or the current, supplied to the relevant part(s) of the hearing instrument.

The at least one stabilizing circuit may, at least during operation, be supplied with power directly from the energy source.

The at least one stabilizing circuit may comprise a current limiter for limitation of the current, e.g. the current supplied to at least the AMP, in response to a supply voltage to the current limiter. This may prevent the supply voltage at the energy source from dropping below a certain level, due to load by the AMP.

The current limiter may be connected in series with the AMP. Further, the current limiter may be for time continuous analog limitation of the current supplied to the AMP in response to the supply voltage on the current limiter as described in US 2006/0233405, where the current limiter is introduced to protect other parts of a hearing instrument against malfunctioning.

The first stabilizing circuit may comprise a first energy storing element. Any energy storing element, e.g. the first energy storing element, may be or may comprise a capacitor and/or any other element that e.g. may work as an energy buffer. An energy storing element may provide power to one or more parts of the hearing instrument, e.g. at least during transient voltage drops.

The hearing instrument may be adapted such that the energy storing element provides power to at least one part of the hearing instrument during transient drops in the supply voltage from the energy source.

The first energy storing element may be adapted for, at least during the transient voltage drops, supplying power to at least one of the ADC, the DSP, and the AMP, such as the ADC and the DSP. Further, the first energy storing element may be coupled in parallel with at least one of the ADC, the DSP, and the AMP. Advantageously, the first energy storing element is provided such that it, at least during the transient voltage drops, may supply power to at least one of the ADC, the DSP, and the AMP, such as the ADC and the DSP. The first energy storing element may for instance be coupled in parallel with a series coupling of the current limiter and the AMP. The first energy storing element may have a capacity of at least 1 μF, such as in a range of 1 μF-10 μF or at least 4.7 μF, e.g. in order to provide sufficient backup supply for the ADC during transient voltage drops at the energy source. The first energy storing element may have a capacity of at least 10 μF, such as in a range of 10 μF-100 μF or at least 47 μF, e.g. in order to provide sufficient backup supply for the ADC and the DSP during transient voltage drops at the energy source. The first energy storing element may have a capacity of at least 100 μF such as in a range of 100 μF-700 μF or at least 470 μF, e.g. in order to provide sufficient backup supply for the AMP and possible also the ADC and/or the DSP during transient voltage drops at the energy source. Any of the values mentioned above for the first energy storing element may define the value for a possible second and/or third energy storing element.

The first stabilizing circuit may comprise a first rectifying element that may be coupled in series with the first energy storing element and may be coupled in series with at least one of the ADC, the DSP, and the AMP. Any rectifying element, e.g. the first rectifying element, may be or comprise an ideal rectifier, such as an ideal diode circuit. Any rectifying element may be or comprise a diode. An ideal rectifier may also be known as a super diode or a precision rectifier. A precision rectifier may comprise a circuit, based on e.g. operational amplifiers, well known in many variants from the literature. An embodiment of an ideal rectifier is shown in FIG. 3 (with a single electric circuit symbol in FIG. 2), and an alternative variant is found in U.S. Pat. No. 6,552,599. The illustrated ideal rectifier has the characteristics of a diode substantially without a voltage drop. This is preferred in some embodiments, since the typical low supply voltage of 1.3 V in a hearing instrument, will not allow sufficient voltage for operating a silicon circuit after a typical silicon diode voltage drop of 0.7 V.

The first rectifying element may be provided for electrically disconnecting, at least during the transient voltage drops, the first energy storing element from at least a part of the hearing instrument, which part may comprise the COM, which may ensure independent supply to the less energy consuming parts of the hearing instrument. The first rectifying element may be provided for preventing, at least during the transient voltage drops, the first energy storing element from supplying power to the COM. This has the advantage that the part(s) of the hearing instrument having stabilized power supply will be less influenced by the power consumption of the COM e.g. during the bursts. Furthermore, the at least one stabilizing circuit may be better suited for providing stabilization of the power to the relevant part(s) of the hearing instrument.

The first stabilizing circuit may comprise a voltage regulator (REG), e.g. feedback controlled, for regulating the supply voltage of at least one of the ADC, the DSP, and the AMP at a steady level, e.g. around 1 V. The steady level may be a lower level than the supply voltage of the first stabilizing circuit at least when the communication unit is not bursting.

The at least one stabilizing circuit and/or the voltage regulator, which for instance may be configured for regulating the AMP, may comprise a switched-mode power supply. This may have the advantage that the voltage supplied to the relevant part(s), e.g. at least one of the ADC, the DSP, and the AMP, may be at a higher level than the voltage of the energy source.

The first stabilizing circuit may be configured to stabilize the supply voltage of at least two of the ADC, the DSP, and the AMP, such as at least all three of them.

The at least one stabilizing circuit may comprise a plurality of stabilizing circuits including the first stabilizing circuit and a second stabilizing circuit. Further, the first stabilizing circuit may be configured to stabilize, e.g. the supply voltage of the AMP.

The second stabilizing circuit may be configured to stabilize the supply voltage of at least one of the following: the audio amplifier, the analog-to-digital converter and the digital signal processor. Provision of a hearing instrument configured for stabilizing the power supply according to individual parts of the hearing instrument may be an advantage. This may in particular be an advantage because the individual stabilizing circuits may be configured for the specific needs of the relevant parts. For instance, if a part, such as the ADC, requires a certain minimal supply voltage but does not draw a significant current compared to other parts of the hearing instrument, e.g. the AMP and/or the COM, it may be an advantage to have a specific stabilizing circuit for the ADC.

For example, the second stabilizing circuit may comprise a second energy storing element, which may be coupled in parallel with the ADC, and a second rectifying element, which may be coupled in series with the second energy storing element and may be coupled in series with the ADC. Thus, the second rectifying element may electrically disconnect, at least during the transient voltage drops, the second energy storing element from at least a part of the hearing instrument, such as the COM and/or the AMP.

The first stabilizing circuit may for example comprise an energy storing element, which may be coupled in parallel with the ADC, and a rectifying element, which may be coupled in series with the energy storing element and may be coupled in series with the ADC, as well as a current limiter coupled in series with the AMP. Thus, the current drawn by the AMP may be limited from drawing excessive current from the energy storing element in the event of a high current consumption by the AMP, at least during the transients. Between the transients, the energy storing element will be provided with power from the energy source.

The hearing instrument may comprise a voltage amplifier for providing the communication unit with a higher voltage than the output voltage of the energy source. The voltage amplifier may be for regulating the supply of the COM exclusively or substantially exclusively. The voltage amplifier may be denoted 2*V. The voltage amplifier may be for doubling the supply voltage of the COM with respect to the output voltage of the energy source.

The hearing instrument in accordance with some embodiments may be (or comprise) a hearing aid, a tinnitus relieving device, a tinnitus therapy device, a noise suppression device, etc., or any combination of two or more of such devices.

The hearing instrument in accordance with some embodiments may comprise a communication unit for wireless (and/or wired) communication between the hearing instrument and one or more other devices, such as hearing instruments, remote controllers, fitting instruments, mobile phones, media players, headsets, door bells, alarm systems, broadcast systems, such as for telecoil replacement, etc, etc.

The communication unit may comprise a receiver and/or a transmitter.

The communication unit may cause, at least during communication bursts, transient voltage drops at the energy source. A transient drop in the output voltage of the energy source may be in a range of 10 μs to 10 ms, such as in a range of 100 μs to 1 ms, such as in a range of 400 μs to 800 μs.

The receiver and/or transmitter of the hearing instrument may be comprised in a radio chip, such as the Nordic Semiconductor radio chip "nRF24I01", commonly operating at voltages above those available in a conventional $ZnO_2$ battery. Therefore it may be required to supply power to the radio chip via a voltage doubler (voltage amplifier). Furthermore, a radio chip of this type may draw significant amounts of current both when it transmits and receives. A conventional $ZnO_2$ battery may only be capable of supplying the required amount of current for a limited time period, typically a few milliseconds, after which it may cease to function. Continued supply of the required amount of current may lead to a lowered supply voltage below which one or more other parts of the hearing instrument, e.g. the digital signal processing circuitry, may stop operating properly. Further, the $ZnO_2$ battery may require time to recover after having supplied current to the radio chip during communication. Therefore, typically the radio chip duty cycle, i.e. the percentage of radio turn-on time with respect to the sum of the radio turn-on and radio turn-off time, should be kept below 10%.

Communication between devices, e.g. in a network, may be synchronized so that every device, e.g. in the network, knows when to transmit and when to receive. Communication, i.e. reception and/or transmission, may be performed in short bursts, which e.g. may be in a range of 10 μs to 10 ms, such as in a range of 100 μs to 1 ms, such as in a range of 400 μs to 800 μs, such as around 600 μs.

The hearing instrument, such as a hearing aid, may be capable of data communication with low power consumption adequately supplied by, e.g. conventional $ZnO_2$ batteries. During wireless data communication, e.g. in bursts, the COM may draw a current of 10-50 mA from the energy source.

However, even though the communication unit may be adequately supplied with power from the energy source, this power consumption by the communication unit during the bursts may still be so high, that one or more other parts of the hearing instrument may malfunction or function in an undesired way during the transient voltage drops due to the bursts, in particular if the at least one stabilizing circuit is not provided.

Hearing instruments according to some embodiments may advantageously be incorporated into a binaural hearing aid system, wherein two hearing aids are interconnected through e.g. the wireless network for digital exchange of data, such as audio signals, signal processing parameters, control data, such as identification of signal processing programs, etc., and optionally interconnected with other devices, such as a remote control, etc. as is known to the person skilled in the art.

Danish patent application PA 2008 01829 and U.S. patent application Ser. No. 12/353,174 disclose further details on a wireless network protocol for a hearing system comprising at least a hearing instrument and another device. The applied frequency ranges has primarily been in the open ISM frequency ranges at 800-900 MHz, and 2.3-2.5 GHz, but in principle such wireless communication may employ frequencies from 100 MHz to 10 GHz. By employing the preferred radio communication instead of the inductive communication common in the prior art the distance of communication will be increased significantly, to a communication range of e.g. 1-10 m, with the associated advantage of freedom of movement for the user of a hearing aid.

According to a second aspect, a method of supplying power to a hearing instrument is provided, which hearing instrument may be configured for wireless communication in bursts. The hearing instrument according to the second aspect may comprise one, more, or all of the following: a microphone for conversion of sound into an input audio signal, an analog-to-digital converter (ADC) for conversion of the input audio signal to a digital input signal, a digital signal processor (DSP) for processing the digital input signal into a processed signal, an audio amplifier (AMP) for amplifying the processed signal, a receiver for conversion of the amplified processed signal into sound, a communication unit (COM), e.g. for duty cycled wireless data communication between the hearing instrument and another device, and an energy source for power supply to the hearing instrument. The hearing instrument according to the second aspect may comprise at least one stabilizing circuit including a first stabilizing circuit. The first stabilizing circuit may comprise a first energy storing element and a first rectifying element. The hearing instrument according to the second aspect may be or comprise a hearing instrument according to the first aspect. Advantageously, the method comprises supplying power from the energy source to the hearing instrument including supplying power through the first rectifying element to the first energy storing element and to a first sub-circuit, respectively. The first sub-circuit may comprise at least one of the analog-to-digital converter, the digital signal processor, and the audio amplifier. The energy storing element may, e.g. during a transient drop in the output voltage of the energy source, be able to supply power, at least transitory, to the first sub-circuit while being prevented from supplying power to the communication unit. The advantages of the second aspect may be the same or similar to the above-mentioned advantages according to the first aspect.

The method may comprise stabilizing the supply voltage of at least one of the ADC, the DSP, and the AMP, e.g. at least during the transient voltage drops.

In accordance with some embodiments, a hearing instrument configured to receive power from an energy source, the energy having an output voltage, the hearing instrument includes an analog-to-digital converter for conversion of an input audio signal to a digital input signal, a digital signal processor for processing the digital input signal into a processed signal, an audio amplifier for amplifying the processed signal, a communication unit for wireless data communication between the hearing instrument and another device, and a first stabilizing circuit configured to provide a stabilized supply voltage to a sub-circuit at least during a transient drop in the output voltage of the energy source, wherein the sub-circuit comprises one or more of the analog-to-digital converter, the digital signal processor, and the audio amplifier, wherein the first stabilizing circuit comprises an energy storing element and a rectifying element, wherein the energy storing element is configured to supply power to the first sub-circuit, and the rectifying element is configured to prevent the energy storing element from supplying power to the communication unit.

In accordance with other embodiments, a hearing instrument configured to receive power from an energy source, the energy having an output voltage, the hearing instrument includes an analog-to-digital converter for conversion of an input audio signal to a digital input signal, a digital signal processor for processing the digital input signal into a processed signal, an audio amplifier for amplifying the processed signal, a communication unit for wireless data communication between the hearing instrument and another device, and a stabilizing circuit having an energy storing element and a rectifying element, wherein the energy storing element is configured to supply power to one or more of the analog-to-digital converter, the digital signal processor, and the audio amplifier, and the rectifying element is configured to prevent the energy storing element from supplying power to the communication unit.

In accordance with other embodiments, a method of supplying power to a hearing instrument includes using an energy storing element to supply power, at least transitory, to a sub-circuit of the hearing instrument, the sub-circuit comprising one or more of an analog-to-digital converter, a digital signal processor, and an audio amplifier, and using a rectifying element to prevent the energy storing element from supplying power to a communication unit of the hearing instrument during a transient drop in an output voltage of an energy source.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals or designations. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting in scope.

The figures are schematic and simplified for clarity. Throughout, the same reference numerals and symbolic texts are used for identical or corresponding parts.

Figure 1:
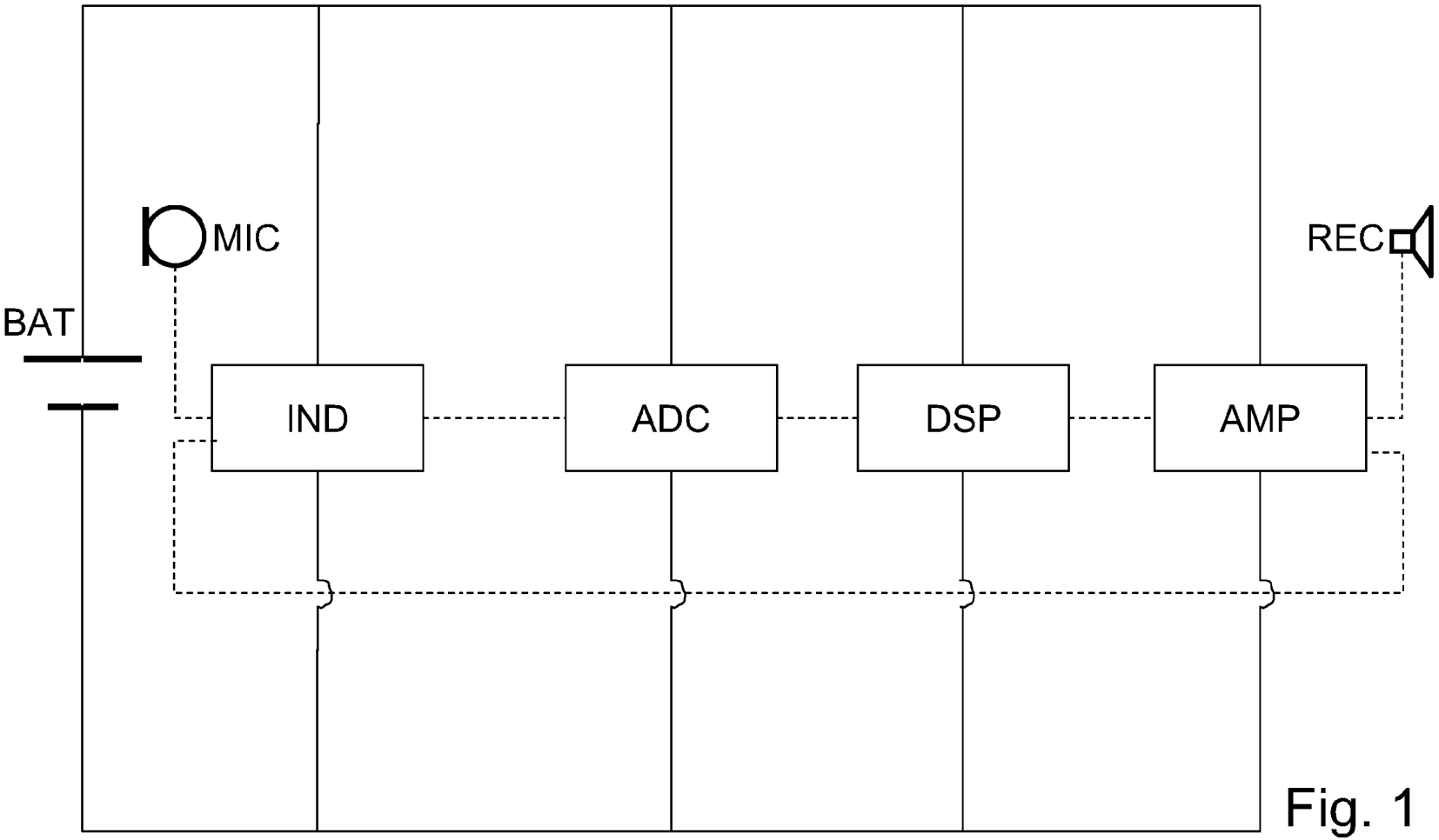
FIG. 1 schematically illustrates a hearing instrument, including signal connections.
Figure 2:
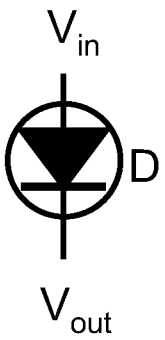
FIG. 2 illustrates a symbol for a rectifying element.
Figure 3:
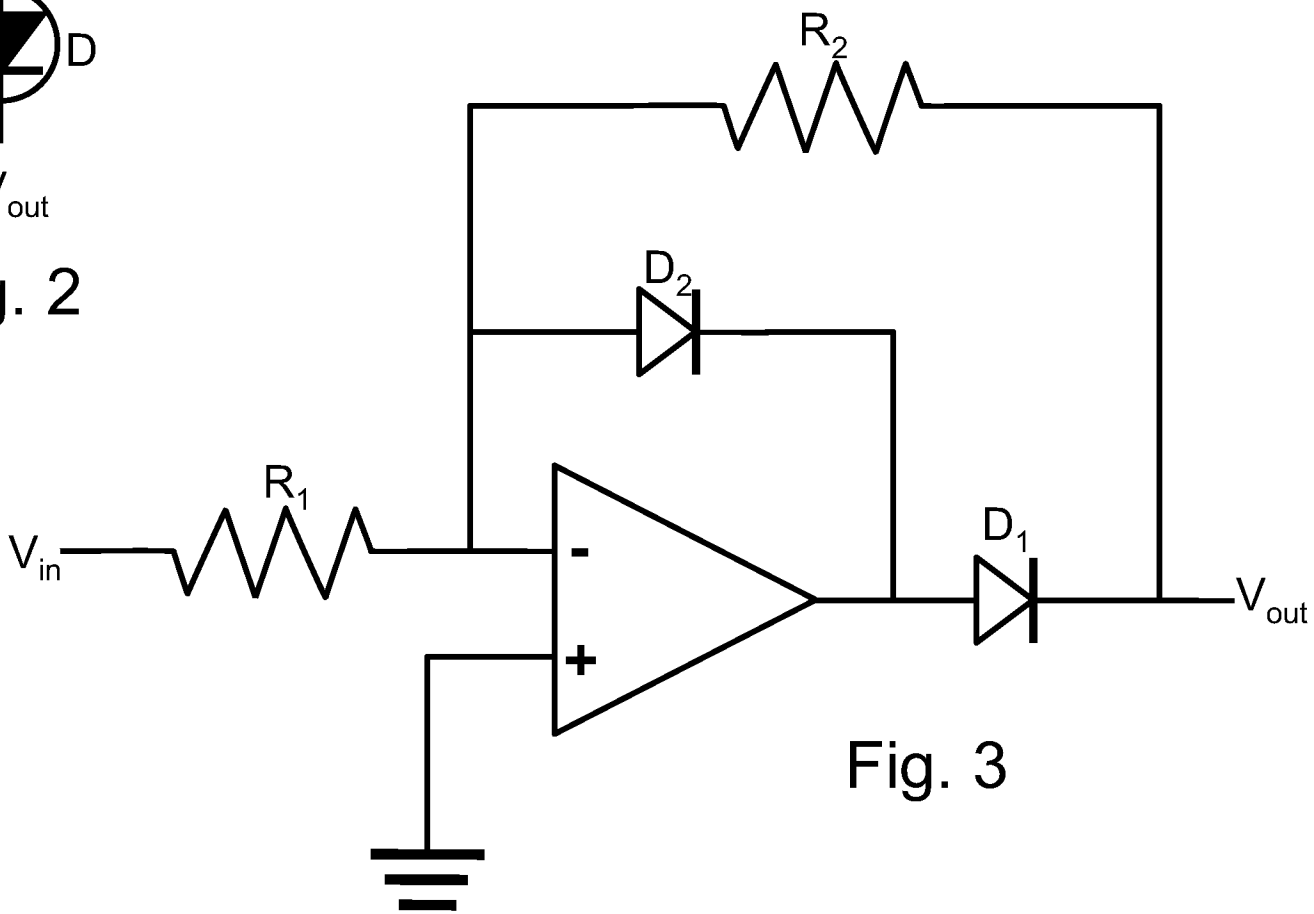
FIG. 3 illustrates an ideal rectifying element circuit.

It should be noted that in addition or in the alternative to the exemplary embodiments shown in the accompanying drawings, the claimed invention may be embodied in different forms and should not be construed as limited to the embodiments set forth herein.

DETAILED DESCRIPTION

Various embodiments are described hereinafter with reference to the figures. It should be noted that the figures are not drawn to scale and that elements of similar structures or functions are represented by like reference numerals or designations throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

In the design of a hearing aid, the size and the power consumption are important considerations. The size of a hearing aid is dependent on the size of the battery used, and to ensure compact and discrete hearing aids, small battery sizes such as the types "312" and "13" are used. The drawback of such small batteries is that they have a relatively large internal resistance. For instance a "312" battery may have a typical internal resistance of 5 ohm which may be a factor 100 higher than the resistance of an AA type battery. The effect of this high internal resistance may be that in the case of high power consumption on the battery, the output voltage of a battery will drop. As only a single battery cell is usually used such a drop in voltage may be critical for the operation of parts of the hearing aid.

The consumption of power in a hearing aid is distributed on various parts. For a digital hearing aid the power consumption may be dominated by wireless communication, especially when the wireless communication is required to have a longer range. In addition, the digital signal processor and the amplifier may also have significant power consumption.

A high signal frequency is desirable for wireless communication since this also means a possibility to provide a high data transfer rate. However, an inherent cost of high signal frequency may be an increased power requirement for generation of the signal. Therefore to ensure efficient use of the battery power it is common practice to operate the wireless transmission duty cycled (i.e. in "burst-mode") where a limited period is used for communication followed by a longer period without communication. Duty cycled wireless communication may also be dictated by regulations and wireless protocols, in order to avoid collision of communication. Such communication may have duty cycles typically varying between 0.5% and 10% and often hopping between 79 frequencies within a frequency band such as 2.4 GHz, and therefore an oscillating power consumption, which will be reflected as transient voltage drops in the battery output voltage.

The different parts of a hearing aid may be affected by variations of supply voltage in different ways.

An ADC may have a low current drain (typically 200-400 μA), but the ADC is dependent of a reference band gap, which commonly may be dependent on the supply voltage. Therefore, the result of voltage variations may be noisy AD conversion, which may be reflected in the digital sound signal transmitted from the AD converter to the signal processor of a hearing aid.

The digital signal processor (DSP) may be dependent on sufficient voltage, since a voltage drop may result in drop out and possibly resetting the DSP. However it may be desired that the DSP is configured to operate at very low voltages (such as 0.7 V), as the power consumption may be highly dependent on the supply voltage. Thus, lower power consumption by the DSP may be achieved, by employing a stable low voltage supply.

In the class D type of amplifier used in hearing aids the supply voltage is reflected directly in the output to the receiver. Therefore, a drop in supply voltage may be reflected as a reduced sound volume, and an oscillating supply voltage may be heard directly as a corresponding oscillation in the output to the receiver, especially if the oscillation is uncorrelated to the sound output.

As mentioned, wireless communication may be a major cause of variations in power consumption and accordingly also variations of supply voltage which may have influence on the sound quality produced by the hearing instrument. Outside the field of hearing instruments, where power consumption and size are less critical, the options for avoiding sound artefacts are fairly open. The common solution to a similar problem of transient voltage drops could be to provide a capacitor having sufficient capacity for supplying power to the wireless module during the burst, and charging between the bursts, and therefore avoid influencing the supply voltage to the other modules. In a hearing aid with wireless radio communication such a capacitor may be required to have capacity of at least 2 mF to filter out the variations in supply voltage. Such a capacitor may have prohibitive physical size, and this is not desired. For a cordless telephone in EP0405783 it has been proposed to provide a dummy power-load current sink drawing current outside bursts to avoid interfering oscillations, which in a hearing aid would mean a prohibitively high power consumption. Accordingly, it has been the common assumption of the skilled person that duty cycled radio communication in hearing instruments is not commercially feasible with 1.3 V batteries.

Previously, it was expected that operation of a hearing aid with duty cycled radio communication, and having power consumption during the bursts resulting in a current draw from the energy source (battery) of up to 50 mA, would result in excessive noise. However, it has now been realised by Applicant that by employing one or more stabilizing circuits matching the different characteristics and demands of the sub-circuits, duty cycled radio communication in a hearing aid is viable, which is a large advantage in the operation of a hearing aid in any frequency range between 100 MHz and 10 GHz, especially in the frequency bands at 800 MHz and 2.4 GHz.

In FIG. 1 is illustrated a hearing instrument comprising sub-units for inductive wireless communication (IND), analog to digital conversion (ADC), digital signal processing (DSP) and amplification and reproduction of sound (AMP). Such a hearing instrument is typically configured for inductive wireless communication, which may draw a current of about 2 mA during bursts, and 200 μA in average. The ADC may consume 400 μA, the DSP may consume 700-1500 μA and the AMP may consume 5-10 mA.

As it is desirable to configure a hearing aid for radio communication at e.g. 2.4 GHz in order to obtain the benefits of increased range and increased data transmission, the prior art power supply must be replaced or modified to obtain a hearing aid operating under this technology. Regarding the power supply, a hearing aid configured for 2.4 GHz radio communication may result in a current drain from the energy source (e.g. the battery) of 10-50 mA during bursts.

For providing stable operation of the ADC, it is recommended that the supply voltage is configured to be above the circuit band gap voltage in operation. However, since the power consumption requirements of the ADC are limited, a limited stabilizing capacity is required. Some of the embodiments described herein propose to provide a stabilizing circuit by a configuring a moderate size capacitor in the range of 4.7 μF for being supplied through an ideal diode circuit. In such a configuration, the capacitor will be configured to provide current to the ADC, while being electrically isolated from supplying current to the wireless circuit. By using an ideal diode circuit without a voltage drop, a configuration for providing sufficient voltage for the ADC may be ensured.

The DSP may be supplied by a voltage down converter, as described in EP1247426, in order to reduce the power consumption. In such a case the DSP may be more robust against transient voltage drops. However, in accordance with some embodiments, the power supply to the DSP may be configured for being supplied by a diode in combination with a capacitor in a configuration similar to that mentioned above, to provide a configuration in which the required voltage supply to the DSP may be provided without or with less influence by the current draw of the COM and/or the AMP. In such a case the capacitor for supplying the DSP may be required to be at least in the range 10-100 μF, such as 47 μF.

The AMP used in modern hearing instruments, is typically a D-class amplifier based on pulse-width modulation. Therefore, a reduced supply voltage is directly reflected in the output to the receiver. In the prior art this is not an issue, since the dominant sources of variation in supply voltage have been battery wear and power consumption of the amplifier. The battery wear is under normal circumstances a slow decay with time, and therefore the change will only be heard, as a slow decay of volume. Furthermore, in the prior art, the effect of the power consumption of the amplifier is known to be correlated to the output volume, and therefore the effect will be difficult to notice for a hearing instrument user. Accordingly, it is known in the prior art (U.S. Pat. No. 6,173,063) to provide a voltage regulator to supply the AMP in a case where the AMP is a major current consumer, with the purpose of avoiding feedback artefacts due to current, and thus transient voltage drops, but it is not known to provide a voltage regulator to supply the AMP a voltage supply stabilized against transient voltage drops due to other hearing aid units such as a duty cycled wireless communication unit.

However, supply voltage oscillations due to bursts of wireless transmission will be reflected directly as audible oscillations of the receiver output, especially since wireless radio bursts will be uncorrelated to the sound. To reduce the effect of variations in supply voltage, embodiments described herein include a voltage regulator for regulating the voltage to the AMP. In such a configuration, as long as the supply voltage is kept above the regulated supply voltage to the AMP, e.g. 1 V, the hearing instrument will be configured for being immune to variations in load on the battery from e.g. the wireless communications unit.

Since the AMP may have a high power consumption, especially in situations with loud sound, it may be beneficial to configure a current limiter for limiting the current in the power supply of the AMP. In this way the AMP is configured for not allowing power consumption to cause a supply voltage drop with negative effect on the operation of the COM and/or the DSP. Such a current limitation may lead to moderate clipping of the output which is far less deteriorating to the sound that duty cycled voltage drops. If a current limiter is configured to be supplied by a stabilizing circuit comprising a rectifying element and a capacitor, the required capacity may also be reduced.

Figure 4:
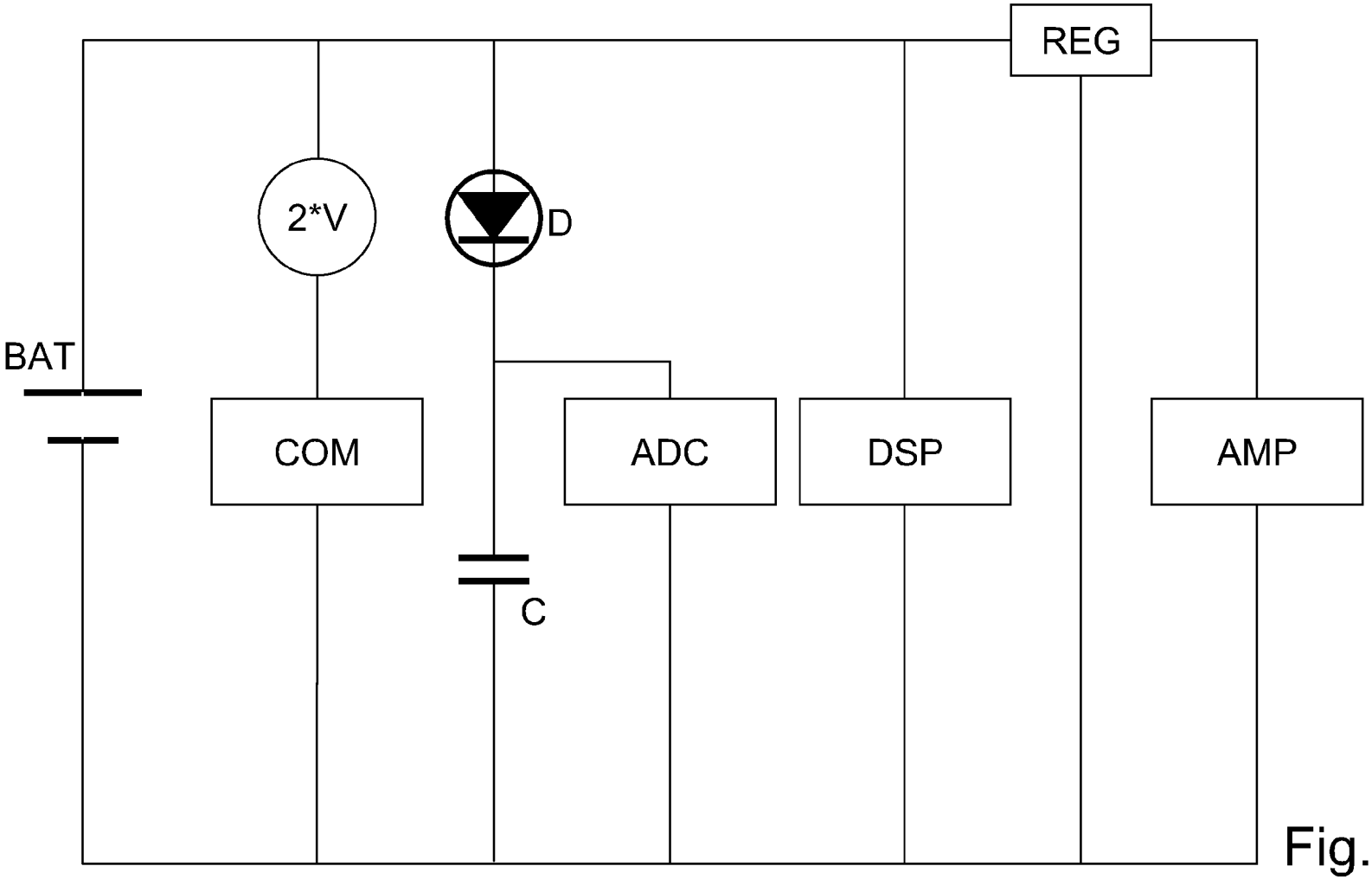
FIG. 4 schematically illustrates a first embodiment, having power stabilization implemented by a stabilizing circuit comprising a rectifying element and a capacitor and a stabilizing circuit comprising a power regulator.

A first embodiment is shown in FIG. 4. The embodiment relates to a hearing aid configured for duty cycled wireless communication, which is configured for having a power supply from a 1.3 V battery (BAT). The COM is supplied with power through a voltage amplifier (2*V). The voltage amplifier is configured for provision of a doubling of the supply voltage in relation to the output voltage of the power supply (BAT). In this embodiment an ideal diode (D) is configured for supplying power to a capacitor (C). The capacitor (C) has a capacitance of 1-10 μF, preferably 4.7 μF. The capacitor is coupled in parallel with the ADC. The capacitor may supply power, at least transitory, to the ADC. The DSP is configured for receiving power from the battery, and having internal regulation. The AMP is configured for having its supply voltage stabilized to 1 V by an active feedback based regulator (REG).

Figure 5:
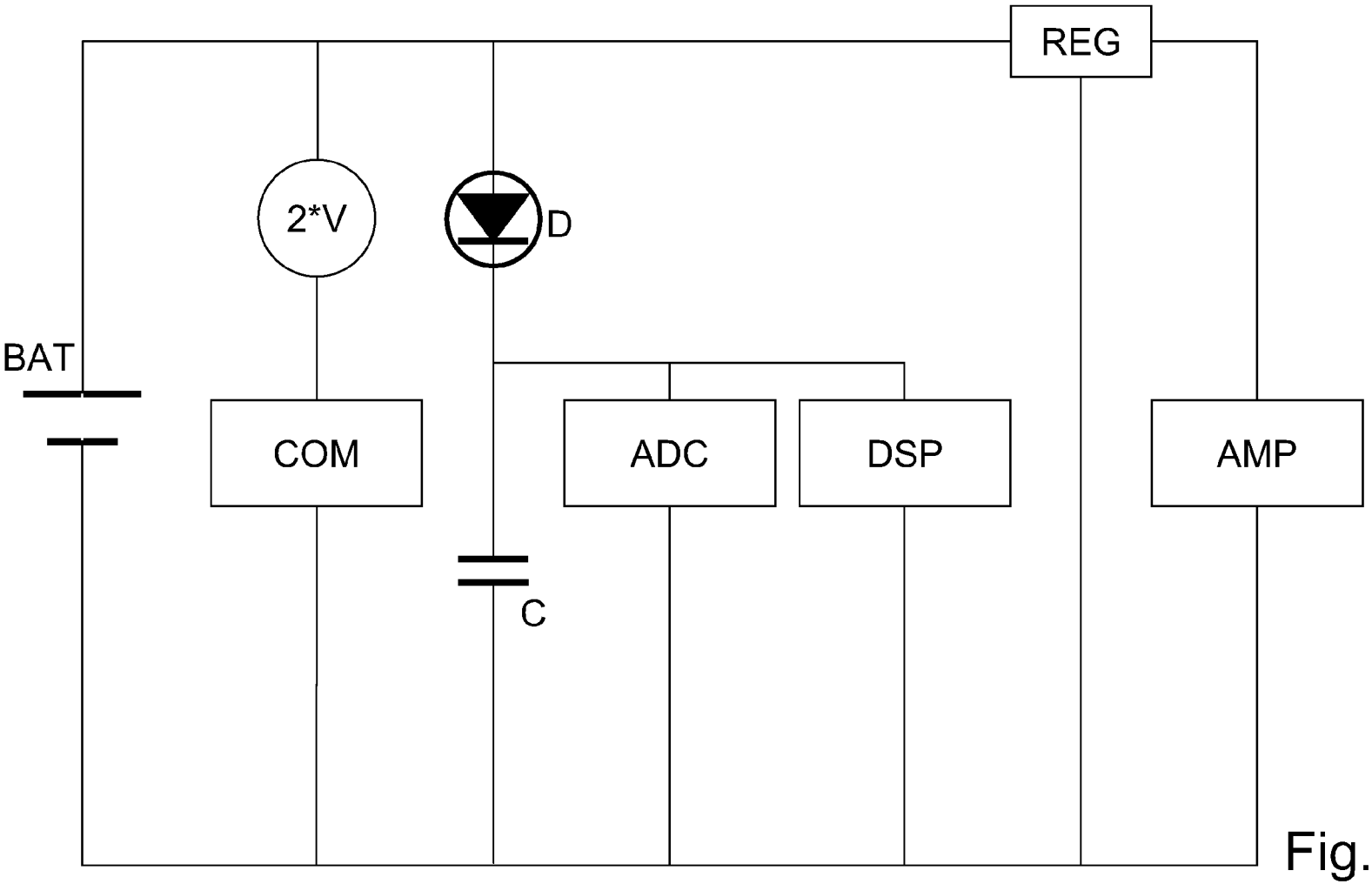
FIG. 5 schematically illustrates a second embodiment, having power stabilization of ADC and DSP implemented by a stabilizing circuit comprising a rectifying element and a capacitor.

Shown in FIG. 5 is an alternative embodiment of a hearing aid configured for duty cycled wireless communication. The power supply for the COM unit is in this embodiment configured for provision of a doubling of the supply voltage. In this embodiment an ideal diode (D) is configured for supplying a capacitor (C), which is configured for supplying the DAC and the DSP. In this embodiment the capacitance of C is required to be ranging between 10 μF and 100 μF. This embodiment has the benefit over the first embodiment, that the DSP does not require internal voltage regulation.

Figure 6:
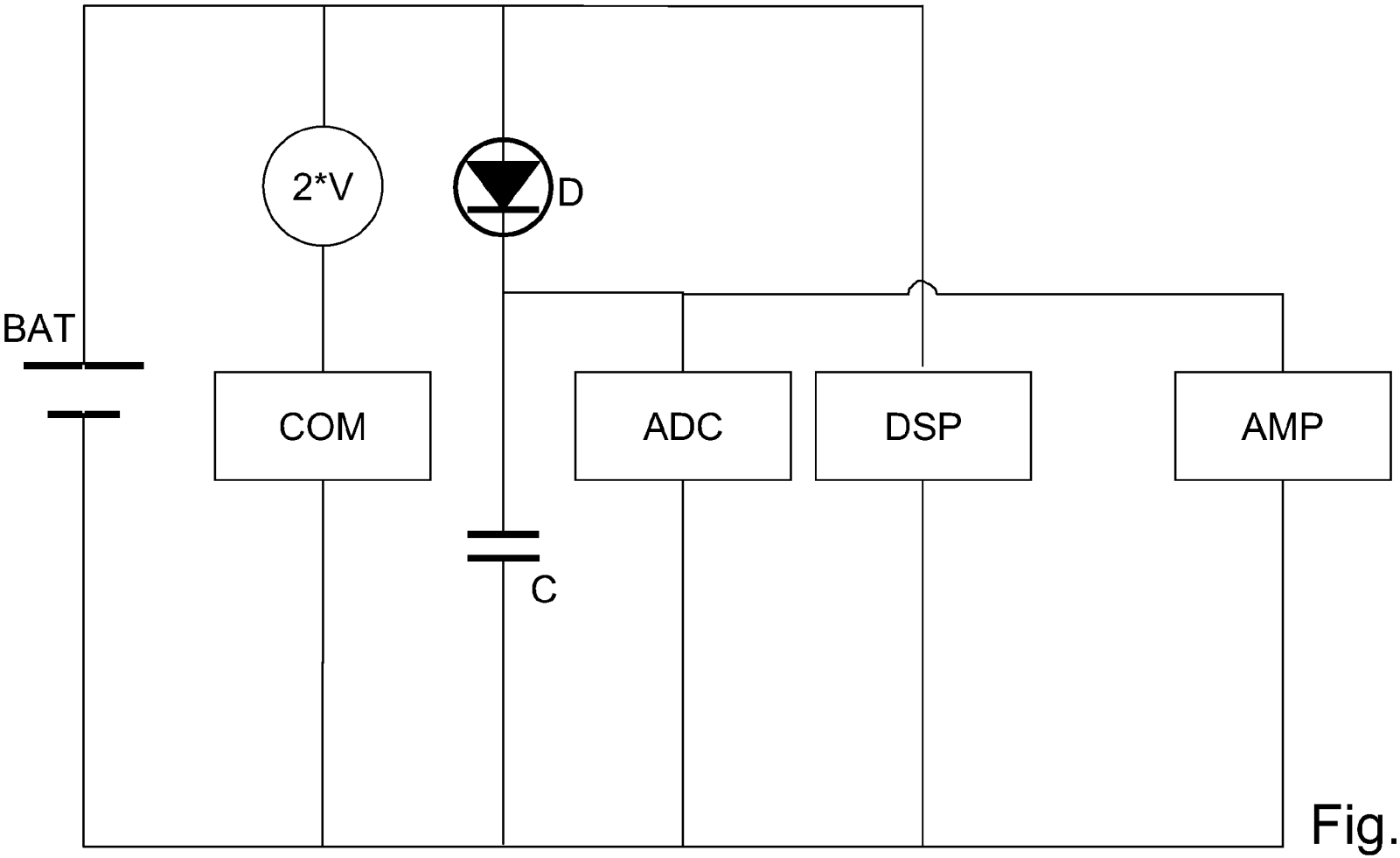
FIG. 6 schematically illustrates an embodiment, having power stabilization of ADC and AMP implemented by a stabilizing circuit comprising a rectifying element and a capacitor.

In FIG. 6 is another alternative embodiment of a hearing aid configured for duty cycled wireless communication. The power supply for the COM unit is in this embodiment configured for provision of a doubling of the supply voltage. In this embodiment an ideal diode (D) is configured for supplying a capacitor (C), which is configured for supplying the ADC and the AMP. The capacitance of C in this embodiment is required to be at least between 100 μF and 700 μF, e.g. 470 μF. This embodiment has the benefit of having a simpler design than the embodiments with a voltage regulator.

Figure 7:
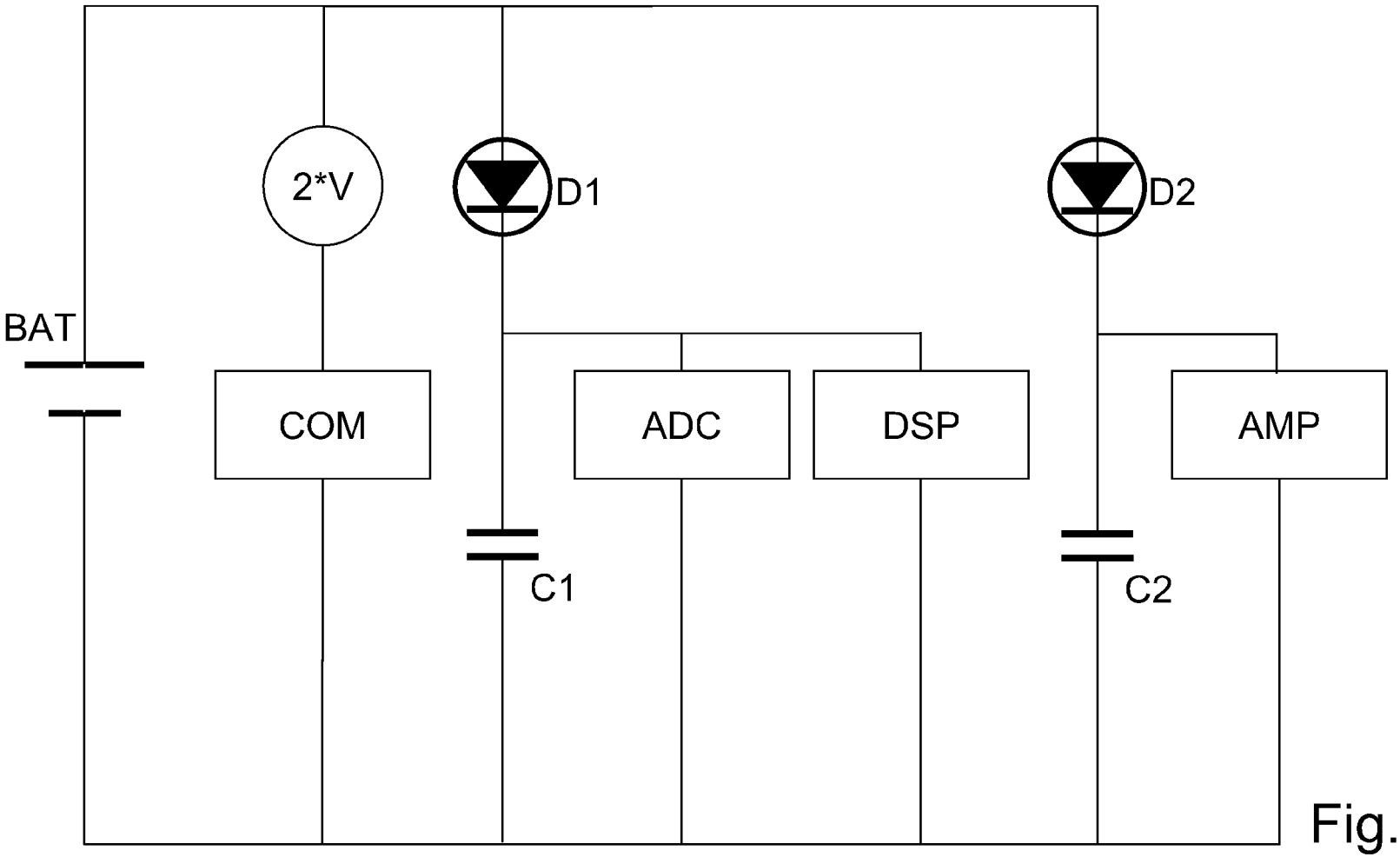
FIG. 7 schematically illustrates an embodiment, having power stabilization of ADC, DSP and AMP implemented by two stabilizing circuits each comprising a rectifying element and capacitor.

FIG. 7 shows another alternative embodiment of a hearing aid configured for duty cycled wireless communication. The power supply for the COM unit is in this embodiment configured for provision of a doubling of the supply voltage. In this embodiment two ideal diodes (D1 and D2) are configured for supplying two capacitors C1 and C2, respectively, which are configured for respectively supplying the ADC and the AMP independently, and thus required to have a capacitance between 1 μF and 10 μF and between 100 μF and 700 μF respectively. This embodiment has the benefit of providing optimal stabilizing circuit configuration for each of the supplied circuits.

Figure 8:
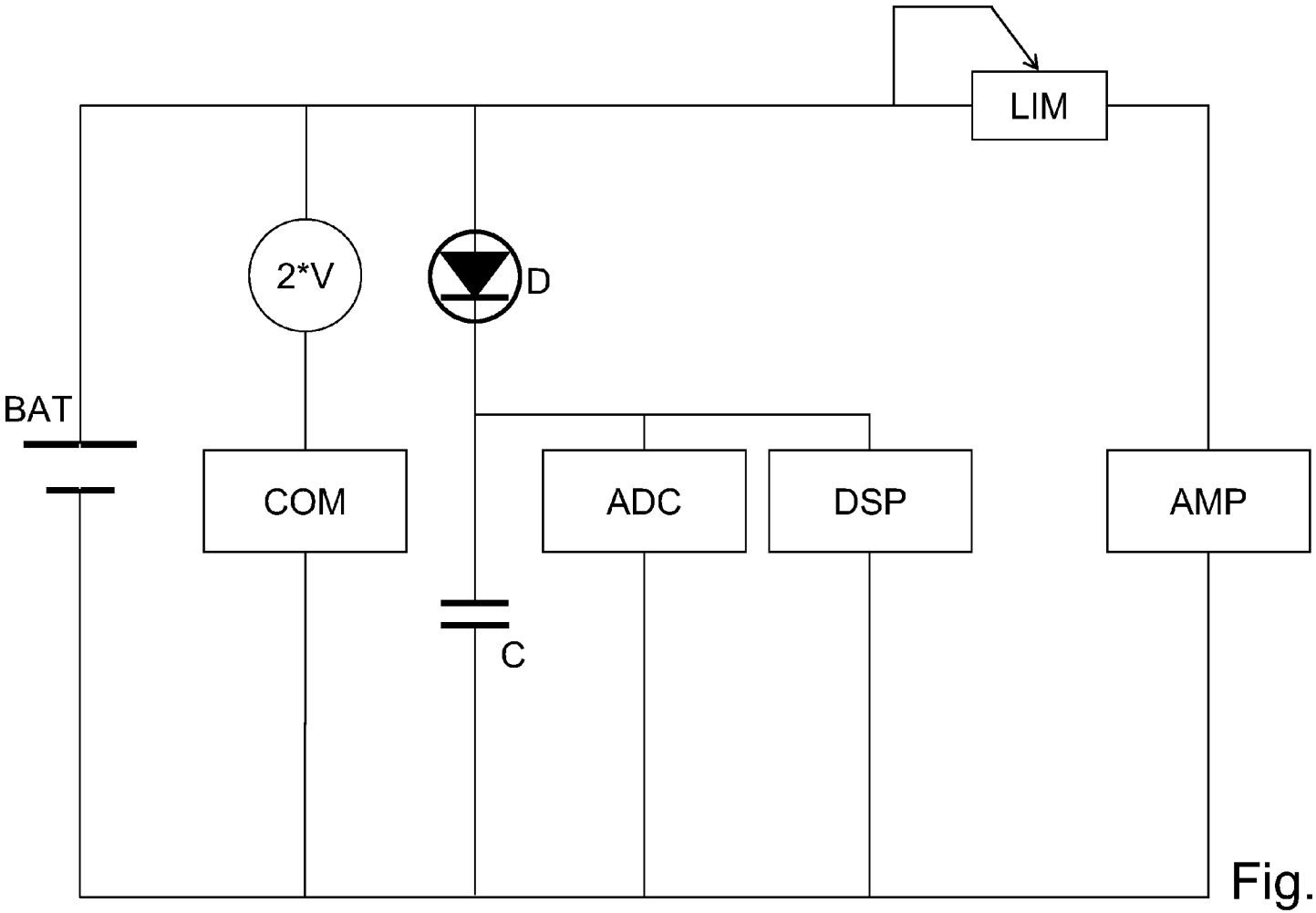
FIG. 8 schematically illustrates an embodiment, having power stabilization of ADC, DSP and AMP implemented by a stabilizing circuit comprising a rectifying element and a capacitor and a stabilizing circuit comprising a current limiter.

Shown in FIG. 8 is a further alternative embodiment of a hearing aid configured for duty cycled wireless communication. The AMP is in this embodiment supplied with power through a current limiter (LIM). In this way the AMP is configured for not allowing power consumption to cause (or to diminish) a supply voltage drop with negative effect on the operation of the COM and/or the DSP. The capacitance is only required to be between 10 μF and 100 μF. This has the benefit of providing a higher stability of the hearing aid, with a moderate total capacitance.

Figure 9:
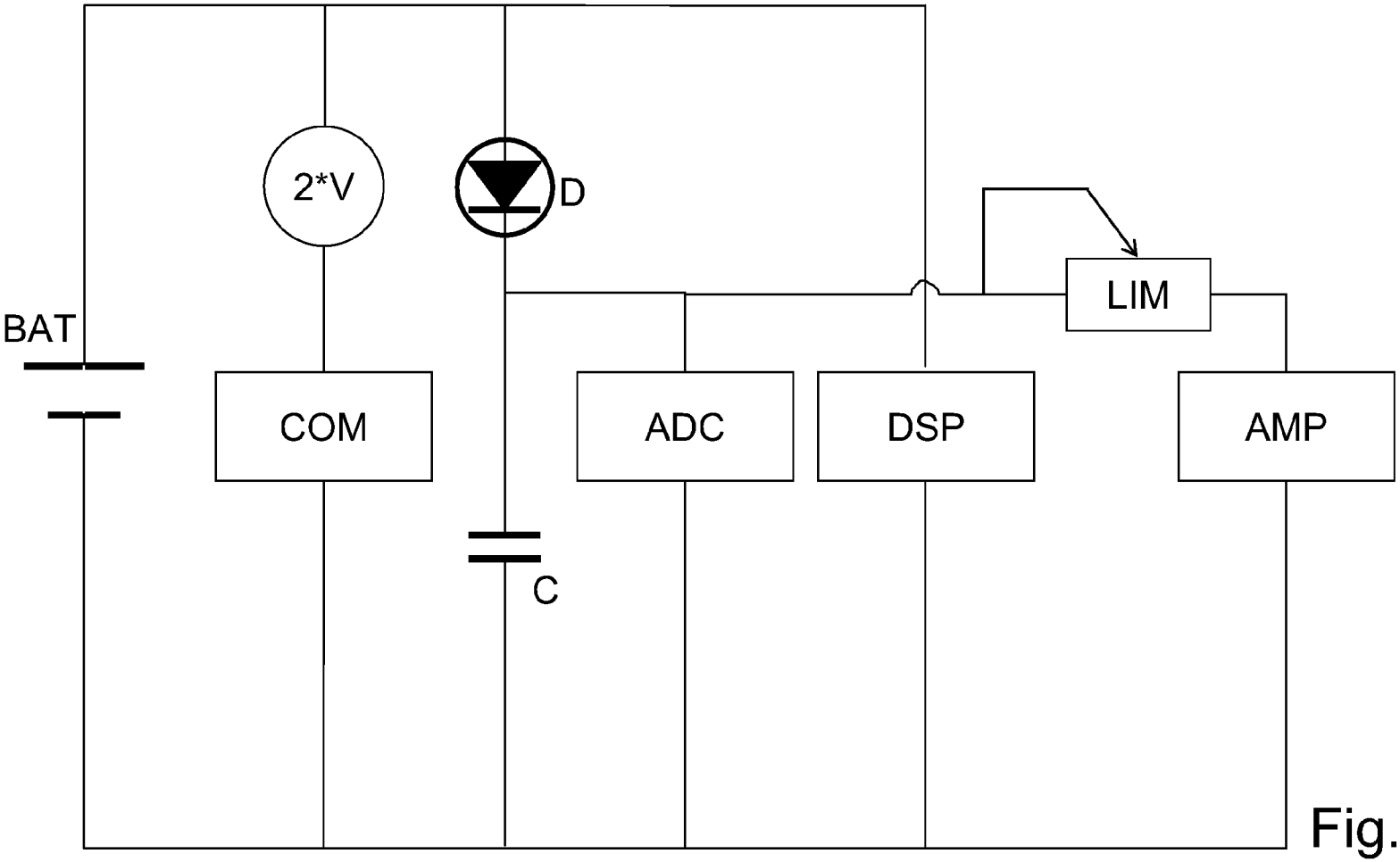
FIG. 9 schematically illustrates an embodiment, having power stabilization of ADC and AMP implemented by a rectifying element, a capacitor, and a current limiter.

Shown in FIG. 9 is a further alternative embodiment of a hearing aid configured for duty cycled wireless communication. The ADC and the AMP are in this embodiment supplied with power from or through a common stabilizing circuit comprising a rectifying element (D) and a capacitor (C). The AMP is connected in series with a current limiter (LIM). In this way the AMP is configured for not allowing power consumption to cause excessive discharge on the capacitor, which may cause a supply voltage drop of the ADC which may conflict with the operation of the ADC. The capacitance may therefore be required to be less than in the embodiment of FIG. 6, such as between 47 μF and 470 μF, e.g. 220 μF. This has the benefit of providing a higher stability of the hearing aid, and an improved sound quality, with a moderate total capacitance, and thus resulting size of the capacitor and preferably also the hearing instrument.

Where the above embodiments state required capacitances, these values correspond to minimum requirements, and do not imply upper limits for the mode of operations. Embodiments described herein may thus be implemented using capacitance exceeding these ranges.

Although particular embodiments of the present inventions have been shown and described, it will be understood that it is not intended to limit the present inventions to the preferred embodiments, and it will be obvious to those skilled in the art that various changes and modifications may be made without departing from the spirit and scope of the present inventions. The specification and drawings are, accordingly, to be regarded in an illustrative rather than restrictive sense. The present inventions are intended to cover alternatives, modifications, and equivalents, which may be included within the spirit and scope of the present inventions as defined by the claims.

The invention claimed is:

1. A hearing instrument configured to receive power from an energy source, the energy having an output voltage, the hearing instrument comprising:

an analog-to-digital converter for conversion of an input audio signal to a digital input signal;

a digital signal processor for processing the digital input signal into a processed signal;

an audio amplifier for amplifying the processed signal;

a communication unit for wireless data communication between the hearing instrument and another device; and a first stabilizing circuit configured to provide a stabilized supply voltage to a sub-circuit at least during a transient drop in an output voltage of the energy source, wherein the sub-circuit comprises one or more of the analog-to-digital converter, the digital signal processor, and the audio amplifier;

wherein the first stabilizing circuit comprises an energy storing element and a rectifying element, wherein the energy storing element is configured to supply power to the first sub-circuit, and the rectifying element is configured to prevent the energy storing element from supplying power to the communication unit.

2. The hearing instrument according to claim 1, wherein the communication unit is configured to perform at least part of the wireless data communication in bursts.

3. The hearing instrument according to claim 1, wherein the transient drop in the output voltage of the energy source is a value between 10 μs and 10 ms.

4. The hearing instrument according to claim 1, wherein the transient drop in the output voltage of the energy source is a value between 100 μs and 1 ms.

5. The hearing instrument according to claim 1, wherein the transient drop in the output voltage of the energy source is a value between 400 μs and 800 μs.

6. The hearing instrument according to claim 1, wherein power consumption of the communication unit during wireless data communication results in a current draw in a range of 10-50 mA from the energy source.

7. The hearing instrument according to claim 1, wherein the first stabilizing circuit comprises a current limiter for limitation of a current supplied to at least the audio amplifier in response to a measured supply voltage at the current limiter.

8. The hearing instrument according to claim 7, wherein the energy storing element is coupled in parallel with a series coupling of the current limiter and the audio amplifier.

9. The hearing instrument according to claim 1, wherein the energy storing element has a capacity of at least 1 μF.

10. The hearing instrument according to claim 1, wherein the energy storing element has a capacity of at least 47 μF.

11. The hearing instrument according to claim 1, wherein the energy storing element has a capacity of at least 470 μF.

12. The hearing instrument according to claim 1, wherein the first stabilizing circuit comprises a feedback controlled voltage regulator for regulating the supply voltage of at least the audio amplifier at a steady level.

13. The hearing instrument according to claim 1, wherein the first stabilizing circuit is configured to provide the stabilized supply voltage for at least two of the analog-to-digital converter, the digital signal processor, and the audio amplifier.

14. The hearing instrument according to claim 1, further comprising a second stabilizing circuit, the second stabilizing circuit configured to stabilize the supply voltage of one or more of the audio amplifier, the analog-to-digital converter, and the digital signal processor.

15. The hearing instrument according to claim 1, wherein the first rectifying element comprises an ideal diode circuit.

16. The hearing instrument according to claim 1, further comprising a voltage amplifier for providing the communication unit with a higher voltage than the output voltage of the energy source.

17. The hearing instrument according to claim 1, wherein the hearing instrument is a hearing aid.

18. A hearing instrument configured to receive power from an energy source, the energy having an output voltage, the hearing instrument comprising:

an analog-to-digital converter for conversion of an input audio signal to a digital input signal;

a digital signal processor for processing the digital input signal into a processed signal;

an audio amplifier for amplifying the processed signal;

a communication unit for wireless data communication between the hearing instrument and another device; and a stabilizing circuit having an energy storing element and a rectifying element, wherein the energy storing element is configured to supply power to one or more of the analog-to-digital converter, the digital signal processor, and the audio amplifier, and the rectifying element is configured to prevent the energy storing element from supplying power to the communication unit.

19. The hearing instrument according to claim 18, wherein the stabilizing circuit comprises a current limiter for limitation of a current supplied to at least the audio amplifier in response to a measured supply voltage at the current limiter.

20. The hearing instrument according to claim 19, wherein the energy storing element is coupled in parallel with a series coupling of the current limiter and the audio amplifier.

21. The hearing instrument according to claim 18, wherein the stabilizing circuit comprises a feedback controlled voltage regulator for regulating the supply voltage of at least the audio amplifier at a steady level.

22. The hearing instrument according to claim 18, wherein the stabilizing circuit is configured to provide the stabilized supply voltage for at least two of the analog-to-digital converter, the digital signal processor, and the audio amplifier.

23. The hearing instrument according to claim 18, wherein the rectifying element comprises an ideal diode circuit.

24. The hearing instrument according to claim 18, further comprising a voltage amplifier for providing the communication unit with a higher voltage than the output voltage of the energy source.

25. The hearing instrument according to claim 18, wherein the hearing instrument is a hearing aid.

26. A method of supplying power to a hearing instrument, comprising: using an energy storing element to supply power, at least transitory, to a sub-circuit of the hearing instrument, the sub-circuit comprising one or more of an analog-to-digital converter, a digital signal processor, and an audio amplifier; and using a rectifying element to prevent the energy storing element from supplying power to a communication unit of the hearing instrument during a transient drop in an output voltage of an energy source, wherein the enemy storing element and the rectifying element are parts of a stabilizing circuit for the hearing instrument, and wherein the communication unit is configured for wireless data communication between the hearing instrument and another device.

* * * * *